US007643094B2

(12) United States Patent
Kawashima et al.

(10) Patent No.: US 7,643,094 B2
(45) Date of Patent: Jan. 5, 2010

(54) COLOR IMAGE PROCESSING APPARATUS, COLOR IMAGE PROCESSING METHOD, PROGRAM AND RECORDING MEDIUM

(75) Inventors: Masahiro Kawashima, Osaka (JP); Masanobu Tanaka, Osaka (JP); Masakazu Ogasawara, Osaka (JP)

(73) Assignee: Panasonic Corporation, Osaka (JP)

( * ) Notice: Subject to any disclaimer, the term of this patent is extended or adjusted under 35 U.S.C. 154(b) by 849 days.

(21) Appl. No.: 10/577,031

(22) PCT Filed: Oct. 27, 2004

(86) PCT No.: PCT/JP2004/015933

§ 371 (c)(1),
(2), (4) Date: Apr. 20, 2006

(87) PCT Pub. No.: WO2005/043501

PCT Pub. Date: May 12, 2005

(65) Prior Publication Data

US 2009/0009664 A1 Jan. 8, 2009

(30) Foreign Application Priority Data

Oct. 30, 2003 (JP) ..... 2003-371209

(51) Int. Cl.
*H04N 9/73* (2006.01)

(52) U.S. Cl. ..... 348/655; 348/743; 348/742; 345/600

(58) Field of Classification Search ..... 348/655, 348/656, 649, 651, 652, 659–662, 742, 743, 348/771; 345/600–605
See application file for complete search history.

(56) References Cited

U.S. PATENT DOCUMENTS

| | | | | |
|---|---|---|---|---|
| 5,721,628 | A * | 2/1998 | Takaragi et al. | 358/518 |
| 5,929,843 | A * | 7/1999 | Tanioka | 345/600 |
| 6,911,963 | B2 * | 6/2005 | Baba et al. | 345/88 |
| 7,477,778 | B2 * | 1/2009 | Ramanath et al. | 382/162 |
| 2003/0128872 | A1 * | 7/2003 | Lee et al. | 382/162 |

FOREIGN PATENT DOCUMENTS

JP 05-241551 9/1993

(Continued)

OTHER PUBLICATIONS

Supplementary European Search Report for PCT/JP2004015933 dated Mar. 27, 2009.
A. Kunzman, G. Pettitt, "White Enhancement for Color-Sequential DLP", SID 98 Digest, May 19, 1998, pp. 121-128, ISSN0098-0966X/98/2901-0121, U.S.

(Continued)

*Primary Examiner*—M. Lee
(74) *Attorney, Agent, or Firm*—RatnerPrestia

(57) ABSTRACT

A color image processing apparatus performs color image display using a red display, green display, blue display and white display. The apparatus includes a white signal generation circuit generating a white signal W based on an input red signal $R_{in}$ for the red display, an input green signal $G_{in}$ for the green display, and an input blue signal $B_{in}$ for the blue display, a yellow signal generation circuit generating a yellow signal Ye, based on the input red signal $R_{in}$, the input green signal $G_{in}$, and the generated white signal W, and a first output white signal generation circuit generating a first output white signal $W_{out}^{(1)}$ for the white display, based on the generated white signal W and the generated yellow signal Ye.

18 Claims, 12 Drawing Sheets

FOREIGN PATENT DOCUMENTS

| | | |
|---|---|---|
| JP | 2001-147666 | 5/2001 |
| JP | 2002-169515 | 6/2002 |
| JP | 2002-169515(A) | 6/2002 |
| JP | 2002-191055 | 7/2002 |
| JP | 2003-248462 | 9/2003 |
| JP | 2003-295812 | 10/2003 |
| JP | 2004-286865 | 10/2004 |
| WO | WO 02/056288(A1) | 7/2002 |

OTHER PUBLICATIONS

International Search Report Corresponding to International Application No. PCT/JP2004/015933 dated Feb. 8, 2005.

* cited by examiner

Fig. 7

Color image processing in comparative example

| Original RGB signal ($R_O$, $G_O$, $B_O$) | Display RGB signal ($R_d^{(0)}$, $G_d^{(0)}$, $B_d^{(0)}$) |
|---|---|
| (255, 255, 0) | (185, 185, 0) |
| (255, 255, 51) | (185, 185, 37) |
| (255, 255, 102) | (185, 185, 74) |
| (255, 255, 153) | (187, 187, 114) |
| (255, 255, 204) | (218, 218, 190) |

Fig. 8

Color image processing in example 1

| Original RGB signal ($R_O$, $G_O$, $B_O$) | Display RGB signal in the case of $K_1 = 0.3$ ($R_d^{(1)}$, $G_d^{(1)}$, $B_d^{(1)}$) | Display RGB signal in the case of $K_1 = 0.4$ ($R_d^{(1)}$, $G_d^{(1)}$, $B_d^{(1)}$) |
|---|---|---|
| (255, 255, 0) | (185, 185, 0) | (196, 196, 74) |
| (255, 255, 51) | (187, 187, 45) | (198, 198, 86) |
| (255, 255, 102) | (195, 195 , 100) | (205, 205, 120) |
| (255, 255, 153) | (210, 210, 152) | (217, 217, 162) |
| (255, 255, 204) | (230, 230, 203) | (234, 234, 207) |

Fig. 9

Color image processing in example 2

| Original RGB signal ($R_O$, $G_O$, $B_O$) | Display RGB signal in the case of ($K_1$,$L_1$) = (0.3,1) ($R_d^{(2)}$, $G_d^{(2)}$, $B_d^{(2)}$) | Display RGB signal in the case of ($K_1$,$L_1$) = (0.4,1) ($R_d^{(2)}$, $G_d^{(2)}$, $B_d^{(2)}$) |
|---|---|---|
| (255, 255, 0) | (185, 185, 0) | (196, 196, 74) |
| (255, 255, 51) | (187, 187, 28) | (198, 198, 80) |
| (255, 255, 102) | (195, 195, 76) | (205, 205, 102) |
| (255, 255, 153) | (210, 210, 126) | (217, 217, 138) |
| (255, 255, 204) | (230, 230, 184) | (234, 234, 189) |

Fig. 10 PRIOR ART

Fig. 11 PRIOR ART

In the case of $W = \min(R_{in}, G_{in}, B_{in}) = B_{in}$

COLOR IMAGE PROCESSING APPARATUS, COLOR IMAGE PROCESSING METHOD, PROGRAM AND RECORDING MEDIUM

This application is a U.S. National Phase Application of PCT International Application PCT/JP2004/015933 dated Oct. 27, 2004.

TECHNICAL FIELD

The present invention relates to a color image processing apparatus, a color image processing method, a program and a recording medium, which is used for direct viewed and projected color image display devices, for example.

BACKGROUND ART

A color image display apparatus employs a CRT, an LCD (Liquid Crystal Device), a DLP (Digital Light Processing Device), a PDP, or the like.

In these color image display devices, three primary colors of red, green and blue are used as the fundamental colors, but in some of LCD displays and DLP projectors, white may be added to enhance the luminosity (e.g., refer to Japanese Patent Laid-Open No. 5-241551).

The entire disclosure of the above patent document is incorporated herein by reference in its entirety.

For example, in a one-chip DLP data projector of field sequential type, a full color image display is made using a four-color color wheel of red, green, blue and white (e.g., refer to A. Kunzman, G. Pettitt, "White Enhancement for Color-Sequential DLP", SID International Symposium Digest of Technical Papers", U.S.A., SID (Society for Information Display), May 1998, Vol. 29, pp. 121-124).

The entire disclosure of the above non-patent document is incorporated herein by reference in its entirety.

Such one-chip DLP data projector can improve the luminosity and contrast and reduce power consumption of the lamp.

Referring chiefly to FIG. 10 that is a block diagram of a conventional color image processing apparatus, the configuration and operation of the conventional color image processing apparatus will be more specifically described below.

The conventional color image processing apparatus displays a full color image using a liquid crystal pixel 5 having a red pixel 1 for making the red display, a green pixel 2 for making the green display, a blue pixel 3 for making the blue display and a white pixel 4 for making the white display, as shown in FIG. 11 that is an explanatory diagram of the conventional liquid crystal pixel 5.

A white signal generation circuit 1000 generates a white signal of 8 bits $$W=\min(R_{in},G_{in},B_{in}), \quad \text{(Formula 1)}$$

based on an input red signal $R_{in}$ of 8 bits for making the red display to be inputted, an input green signal $G_{in}$ of 8 bits for making the green display to be inputted, and an input blue signal $B_{in}$ of 8 bits for making the blue display to be inputted.

In this manner, in the conventional color image processing apparatus, the white signal W is generated to add white to enhance the luminosity.

However, the present inventor has noticed that the conventional color image display using the red display, green display, blue display, and white display may cause a sense of incompatibility in the appearance of the colors of yellow, cyan and magenta.

More specifically, the present inventor has made sure that particularly yellow remarkably tends to look darker among yellow, cyan and magenta.

DISCLOSURE OF THE INVENTION

In view of the above-mentioned problems associated with the prior art, it is an object of the invention to provide a color image processing apparatus, a color image processing method, a program and a recording medium, in which it is possible to reduce a sense of incompatibility in the appearance of the colors, such as yellow looking darker, in the color image display using the red display, green display, blue display, and white display.

To come to the point, the cause of a sense of incompatibility in the appearance of the colors resides in that the luminosity contrast between white, of which luminosity is enhanced, and other colors may be too great in some cases because the white signal $$W=\min(R_{in},G_{in},B_{in}) \quad \text{(Formula 1)}$$

is used as it is and consequently white is added, as will be more easily understood by referring to FIG. 12 that is an explanatory diagram of a principle with pseudo-histograms in which the signal value of each signal is taken as the length of side of the rectangle in the longitudinal direction for the conventional color image processing apparatus.

In practice, if white is added using the white signal W directly, W is equal to 0, when at least one of $R_{in}$, $G_{in}$ and $B_{in}$ is 0.

For example, when yellow is displayed where $R_{in}$=255, $G_{in}$=255 and $B_{in}$=0 (at this time, W=0), the brightness ratio in terms of the liquid crystal pixel 5 is halved, as compared with when white is displayed where $R_{in}$=255, $G_{in}$=255 and $B_{in}$=255 (at this time, W=255).

Therefore, yellow looks quite darker than white of which luminosity is enhanced.

And the cause of the sense of incompatibility is considered due partly to the fact that the actual luminosity is deviated from the luminosity sense memorized in the brain. Though being memorized light in the brain, yellow where $R_{in}$=255, $G_{in}$=255 and $B_{in}$=0, cyan where $R_{in}$=0, $G_{in}$=255 and $B_{in}$=255, and magenta where $R_{in}$=255, $G_{in}$=0 and $B_{in}$=255 tend to look darker.

This tendency is stronger in the order of magenta, cyan and yellow, and is remarkable with yellow which the brain memorizes to be particularly light.

Thus, the white display is made using the first output white signal $W_{out}^{(1)}$ generated by increasing the white signal W according to the magnitude of yellow signal $$Ye=\min(R_{in}-W,G_{in}-W) \quad \text{(Formula 2)}$$

whereby it is possible to suppress an evil influence that yellow looks darker because of too large luminosity contrast with white of which luminosity is enhanced, as will be more easily understood by referring to FIG. 1 that is an explanatory diagram (No. 1) of the principle with pseudo-histograms in which the signal value of each signal is taken as the length of side of the rectangle in the longitudinal direction for the color image processing apparatus according to the embodiment of the invention.

A first aspect of the present invention is a color image processing apparatus of performing a color image display using a red display, a green display, a blue display and a white display, comprising:

white signal generation instrument which generates a white signal $$W=\min(R_{in},G_{in},B_{in}), \quad \text{(Formula 1)}$$

based on an input red signal $R_{in}$ for making said red display to be inputted, an input green signal $G_{in}$ for making said green display to be inputted, and an input blue signal $B_{in}$ for making said blue display to be inputted;

yellow signal generation instrument which generates a yellow signal $$Ye=\min(R_{in}-W,G_{in}-W), \quad \text{(Formula 2)}$$

based on said input red signal $R_{in}$ to be inputted, said input green signal $G_{in}$ to be inputted, and said generated white signal W; and first output white signal generation instrument which generates a first output white signal $W_{out}^{(1)}$ for making said white display to be outputted, based on said generated white signal W and said generated yellow signal Ye, wherein said first output white signal generation instrument generates said first output white signal $W_{out}^{(1)}$ $$W_{out}^{(1)}=W+K_1\cdot Ye \quad \text{(Formula 3)}$$

for a predetermined positive constant $K_1$.

A second aspect of the present invention is the color image processing apparatus according to the first aspect of the present invention, wherein said first output white signal generation instrument generates said first output white signal $W_{out}^{(1)}$ $$W_{out}^{(1)}=W+K_1\cdot Ye \quad \text{(Formula 3)}$$

for a predetermined positive constant $K_1$.

A third aspect of the present invention is the color image processing apparatus according to the first aspect of the present invention, further comprising output blue signal generation instrument which generates an output blue signal $B_{out}$ for making said blue display to be outputted, based on said input blue signal $B_{in}$ for making the blue display to be inputted, said generated yellow signal Ye, and said generated white signal W.

A fourth aspect of the present invention is the color image processing apparatus according to the third aspect of the present invention, wherein said output blue signal generation instrument generates said output blue signal $B_{out}$ $$B_{out}=B_{in}-L_1\cdot Ye\cdot W \quad \text{(Formula 4)}$$

for a predetermined positive constant $L_1$.

A fifth aspect of the present invention is the color image processing apparatus according to the first aspect of the present invention, further comprising cyan signal generation instrument which generates a cyan signal $$Cy=\min(G_{in}-W,B_{in}-W), \quad \text{(Formula 5)}$$

based on said input green signal $G_{in}$ to be inputted, said input blue signal $B_{in}$ to be inputted, and said generated white signal W, and second output white signal generation instrument which generates a second output white signal $W_{out}^{(2)}$ for making said white display to be outputted, instead of said first output white signal $W_{out}^{(1)}$, based on said generated first output white signal $W_{out}^{(1)}$ and said generated cyan signal Cy.

A sixth aspect of the present invention is the color image processing apparatus according to the fifth aspect of the present invention, wherein said second output white signal generation instrument generates said second output white signal $W_{out}^{(2)}$ $$W_{out}^{(2)}=W_{out}^{(1)}+K_2\cdot Cy \quad \text{(Formula 6)}$$

for a predetermined positive constant $K_2$.

A seventh aspect of the present invention is the color image processing apparatus according to the fifth aspect of the present invention, further comprising output red signal generation instrument which generates an output red signal $R_{out}$ for making said red display to be outputted, based on said input red signal $R_{in}$ for making the red display to be inputted, said generated cyan signal Cy, and said generated first output white signal $W_{out}^{(1)}$.

An eighth aspect of the present invention is the color image processing apparatus according to the seventh aspect of the present invention, wherein said output red signal generation instrument generates said output red signal $R_{out}$ $$R_{out}=R_{in}-L_2\cdot Cy\cdot W_{out}^{(1)} \quad \text{(Formula 7)}$$

for a predetermined positive constant $L_2$.

A ninth aspect of the present invention is the color image processing apparatus according to the fifth aspect of the present invention, further comprising magenta signal generation instrument which generates a magenta signal $$Ma=\min(B_{in}-W,R_{in}-W), \quad \text{(Formula 8)}$$

based on said input blue signal $B_{in}$ to be inputted, said input red signal $R_{in}$ to be inputted, and said generated white signal W, and third output white signal generation instrument which generates a third output white signal $W_{out}^{(3)}$ for making said white display to be outputted, instead of said second output white signal $W_{out}^{(2)}$ based on said generated second output white signal $W_{out}^{(2)}$ and said generated magenta signal Ma.

A tenth aspect of the present invention is the color image processing apparatus according to the ninth aspect of the present invention, wherein said third output white signal generation instrument generates said third output white signal $W_{out}^{(3)}$ $$W_{out}^{(3)}=W_{out}^{(2)}+K_3\cdot Ma \quad \text{(Formula 9)}$$

for a predetermined positive constant $K_3$.

An eleventh aspect of the present invention is the color image processing apparatus according to the ninth aspect of the present invention, further comprising output green signal generation instrument which generates an output green signal $G_{out}$ for making said green display to be outputted, based on said input green signal $G_{in}$ for making the green display to be inputted, said generated magenta signal Ma, and said generated second output white signal $W_{out}^{(2)}$.

A twelfth aspect of the present invention is the color image processing apparatus according to the eleventh aspect of the present invention, wherein said output green signal generation instrument generates said output green signal $G_{out}$ $$G_{out}=G_{in}-L_3\cdot Ma\cdot W_{out}^{(2)} \quad \text{(Formula 10)}$$

for a predetermined positive constant $L_3$.

A thirteenth aspect of the present invention is a color image processing method of performing a color image display using a red display, a green display, a blue display and a white display, comprising:

a white signal generation step of generating a white signal $$W=\min(R_{in},G_{in},B_{in}), \quad \text{(Formula 1)}$$

based on an input red signal $R_{in}$ for making said red display to be inputted, an input green signal $G_{in}$ for making said green display to be inputted, and an input blue signal $B_{in}$ for making said blue display to be inputted;

a yellow signal generation step of generating a yellow signal $$Ye=\min(R_{in}-W, G_{in}-W), \quad \text{(Formula 2)}$$

based on said input red signal $R_{in}$ to be inputted, said input green signal $G_{in}$ to be inputted, and said generated white signal W; and a first output white signal generation step of generating a first output white signal $W_{out}^{(1)}$ for making said white display to be outputted, based on said generated white signal W and said generated yellow signal Ye, wherein said first output white signal $W_{out}^{(1)}$ is generated as $$W_{out}^{(1)}=W+K_1 \cdot Ye \quad \text{(Formula 3)}$$

for a predetermined positive constant $K_1$.

A fourteenth aspect of the present invention is the color image processing method according to the thirteenth aspect of the present invention, further comprising an output blue signal generation step of generating an output blue signal $B_{out}$ for making said blue display to be outputted, based on said input blue signal $B_{in}$ for making the blue display to be inputted, said generated yellow signal Ye, and said generated white signal W.

A fifteenth aspect of the present invention is the color image processing method according to the thirteenth aspect of the present invention, further comprising a cyan signal generation step of generating a cyan signal $$Cy=\min(G_{in}-W, B_{in}-W), \quad \text{(Formula 5)}$$

based on said input green signal $G_{in}$ to be inputted, said input blue signal $B_{in}$ to be inputted, and said generated white signal W, and a second output white signal generation step of generating a second output white signal $W_{out}^{(2)}$ for making said white display to be outputted, instead of said first output white signal $W_{out}^{(1)}$ based on said generated first output white signal $W_{out}^{(1)}$ and said generated cyan signal Cy.

A sixteenth aspect of the present invention is the color image processing method according to the fifteenth aspect of the present invention, further comprising an output red signal generation step of generating an output red signal $R_{out}$ for making said red display to be outputted, based on said input red signal $R_{in}$ for making the red display to be inputted, said generated cyan signal Cy, and said generated first output white signal $W_{out}^{(1)}$.

A seventeenth aspect of the present invention is the color image processing method according to the fifteenth aspect of the present invention, further comprising a magenta signal generation step of generating a magenta signal $$Ma=\min(B_{in}-W, R_{in}-W), \quad \text{(Formula 8)}$$

based on said input blue signal $B_{in}$ to be inputted, said input red signal $R_{in}$ to be inputted, and said generated white signal W, and a third output white signal generation step of generating a third output white signal $W_{out}^{(3)}$ for making said white display to be outputted, instead of said second output white signal $W_{out}^{(2)}$, based on said generated second output white signal $W_{out}^{(2)}$ and said generated magenta signal Ma.

An eighteenth aspect of the present invention is the color image processing method according to the seventeenth aspect of the present invention, further comprising an output green signal generation step of generating an output green signal $G_{out}$ for making said green display to be outputted, based on said input green signal $G_{in}$ for making the green display to be inputted, said generated magenta signal Ma, and said generated second output white signal $W_{out}^{(2)}$.

A nineteenth aspect of the present invention is a recording medium which is computer processable and records a program for enabling a computer to perform the color image processing method according to the thirteenth aspect of the present invention, comprising:

a white signal generation step of generating a white signal $$W=\min(R_{in}, G_{in}, B_{in}), \quad \text{(Formula 1)}$$

based on an input red signal $R_{in}$ for making said red display to be inputted, an input green signal $G_{in}$ for making said green display to be inputted, and an input blue signal $B_{in}$ for making said blue display to be inputted;

a yellow signal generation step of generating a yellow signal $$Ye=\min(R_{in}-W, G_{in}-W), \quad \text{(Formula 2)}$$

based on said input red signal $R_{in}$ to be inputted, said input green signal $G_{in}$ to be inputted, and said generated white signal W; and a first output white signal generation step of generating a first output white signal $W_{out}^{(1)}$ for making said white display to be outputted, based on said generated white signal W and said generated yellow signal Ye.

The present invention has an advantage in which it is possible to reduce a sense of incompatibility in the appearance of the colors, such as yellow looking darker, in the color image display using the red display, green display, blue display, and white display.

BRIEF DESCRIPTION OF THE DRAWINGS

FIG. 7 is an explanatory diagram showing the simulation results of the color image processing in a comparative example of the invention;

FIG. 8 is an explanatory diagram showing the simulation results of the color image processing in an example 1 of the invention;

FIG. 9 is an explanatory diagram showing the simulation results of the color image processing in an example 2 of the invention;

DESCRIPTION OF SYMBOLS

Figure 1:
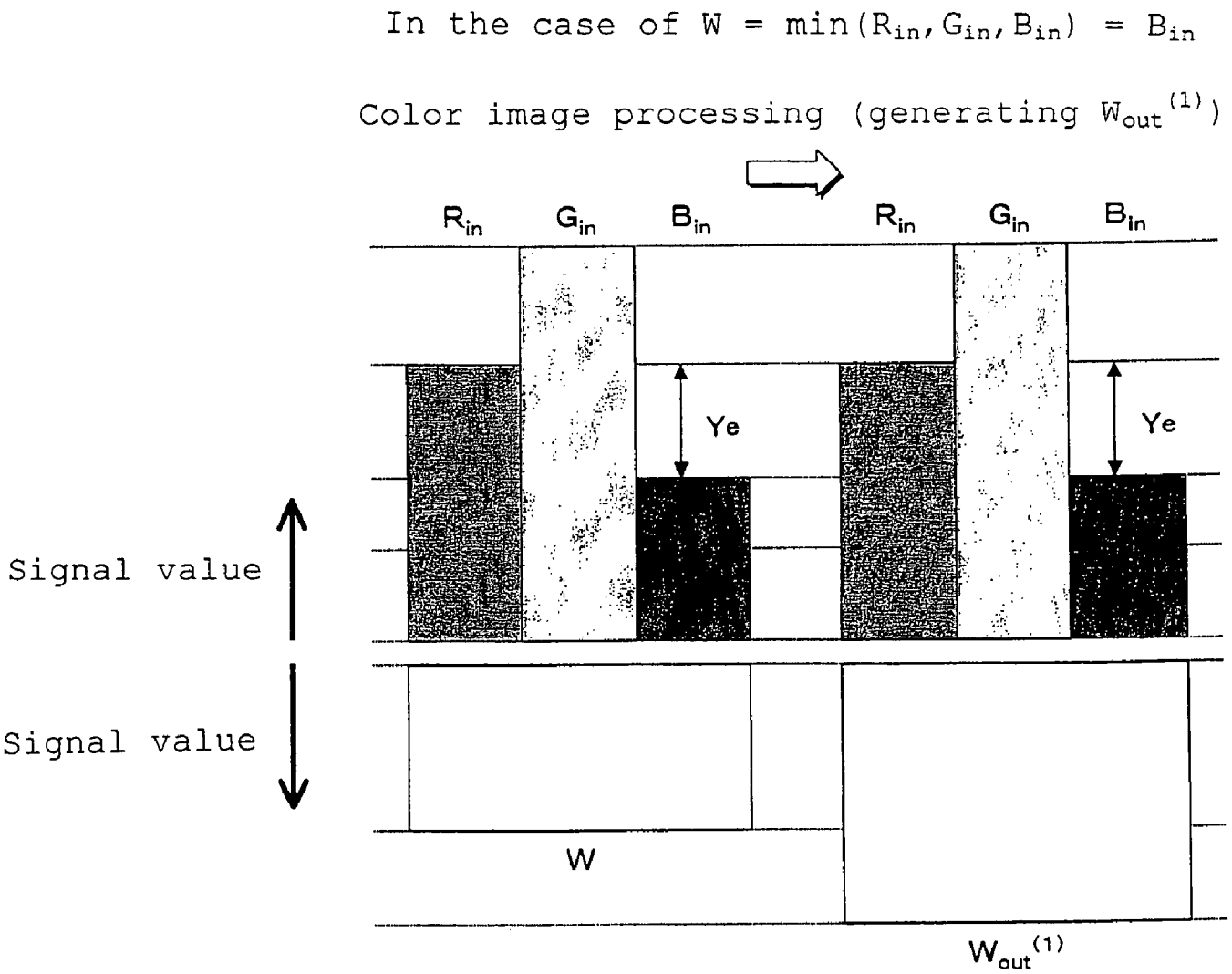
FIG. 1 is an explanatory view (No. 1) of the principle with pseudo-histograms in which the signal value of each signal is taken as the length of side of the rectangle in the longitudinal direction for a color image processing apparatus according to an embodiment of the invention.

1 red pixel
2 green pixel
3 blue pixel
4 white pixel
5 liquid crystal pixel
100 minimum value detector
201 subtracter
302 subtracter
412 minimum value detector
512 multiplier
612 adder
703 multiplier
803 multiplier
903 subtracter
1000 white signal generation circuit
2012 yellow signal generation circuit
3012 first output white signal generation circuit
4003 output blue signal generation circuit
202 subtracter
303 subtracter
423 minimum value detector
523 multiplier
623 adder
701 multiplier
801 multiplier
901 subtracter
2023 cyan signal generation circuit
3023 second output white signal generation circuit
4001 output red signal generation circuit
203 subtracter
301 subtracter
431 minimum value detector
531 multiplier
631 adder
702 multiplier
802 multiplier
902 subtracter
2031 magenta signal generation circuit
3031 third output white signal generation circuit
4002 output green signal generation circuit

BEST MODE FOR CARRYING OUT THE INVENTION

The preferred embodiments of the present invention will be described below with reference to the drawings.

Embodiment

Figure 2:
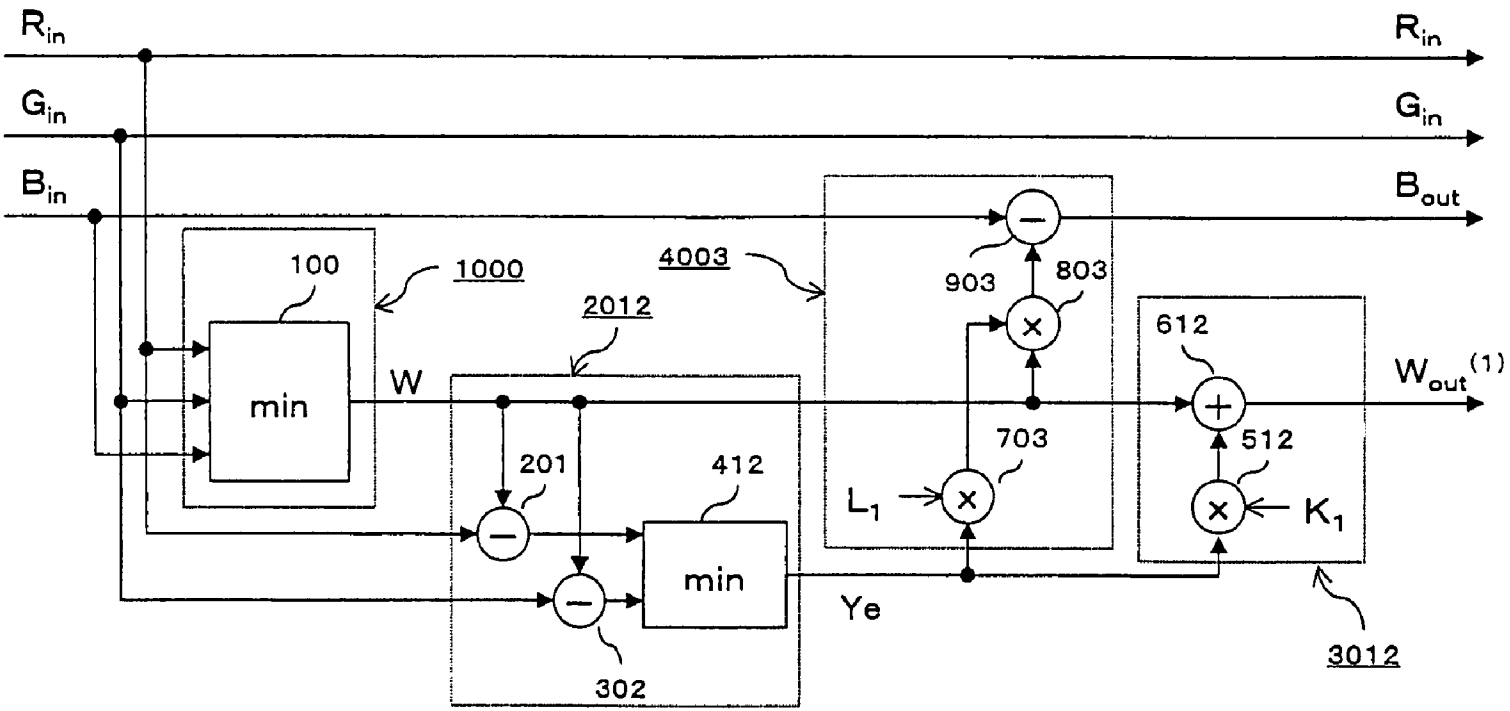
FIG. 2 is a block diagram of the color image processing apparatus according to the embodiment of the invention.

To begin with, referring chiefly to FIG. 2 that is a block diagram of a color image processing apparatus according to an embodiment of the invention, the configuration of the color image processing apparatus of this embodiment will be described below.

The principle of the color image processing apparatus of this embodiment will be described later.

Figure 11:
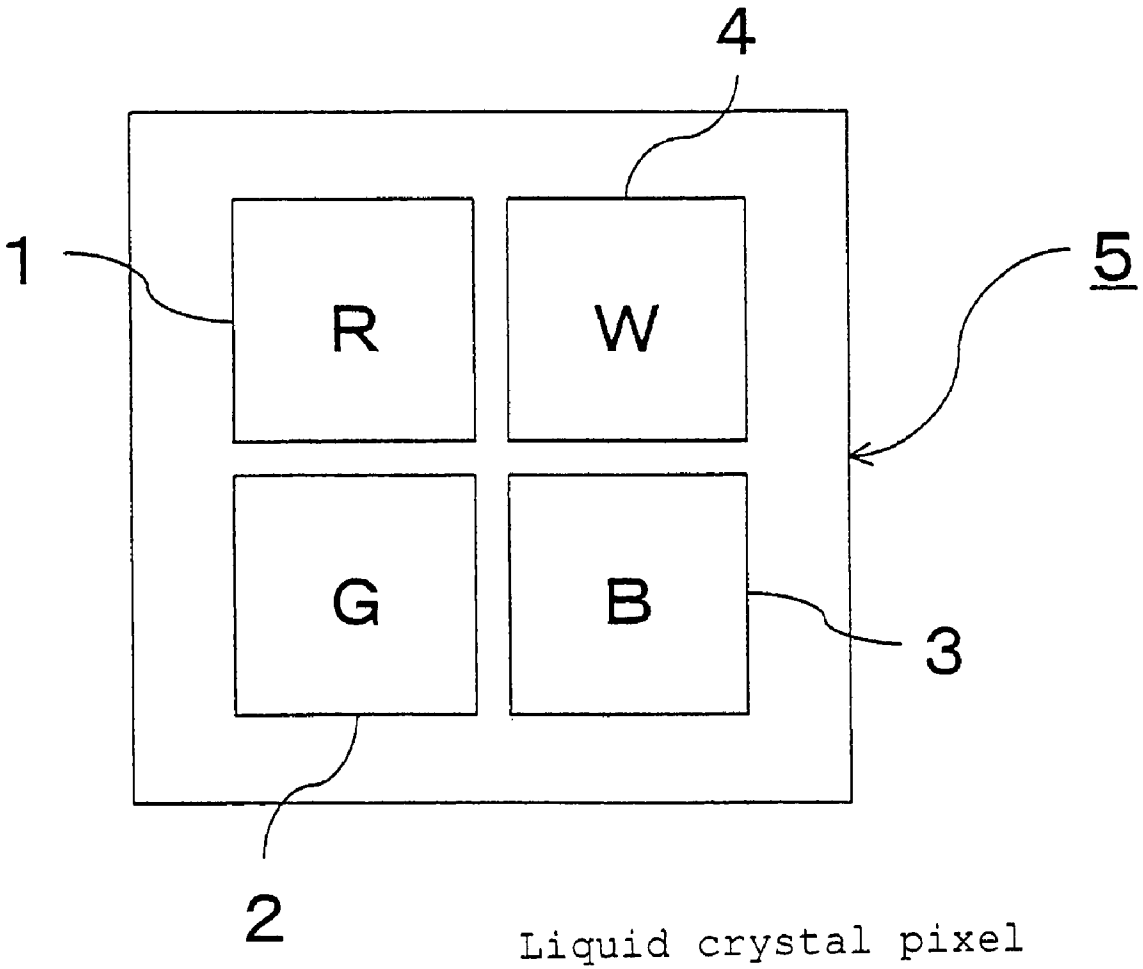
FIG. 11 is an explanatory diagram of the conventional liquid crystal pixel 5.
Figure 12:
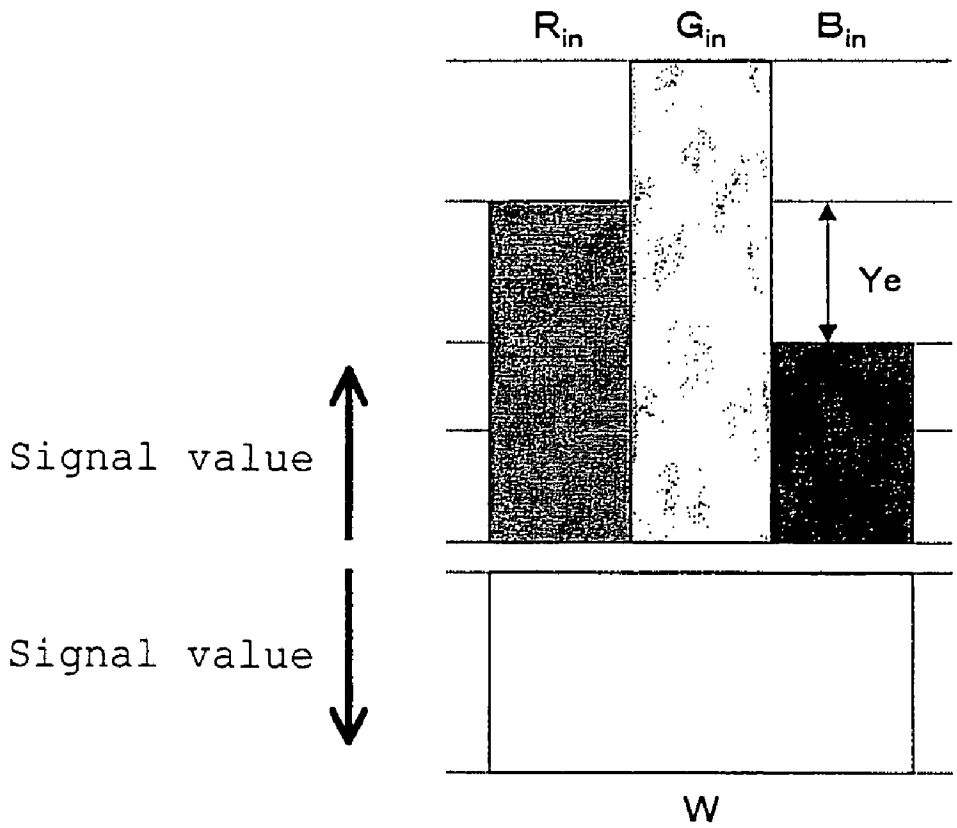
FIG. 12 is an explanatory diagram of the principle with pseudo-histograms in which the signal value of each signal is taken as the length of side of the rectangle in the longitudinal direction for the conventional color image processing apparatus.

The color image processing apparatus of this embodiment displays the full color image using a liquid crystal pixel 5 having a red pixel 1 for making the red display, a green pixel 2 for making the green display, a blue pixel 3 for making the blue display and a white pixel 4 for making the white display (see FIG. 11).

As described earlier, a white signal generation circuit 1000 generates a white signal of 8 bits $$W=\min(R_{in}, G_{in}, B_{in}), \quad \text{(Formula 1)}$$

based on an input red signal $R_{in}$ of 8 bits for making red display to be inputted, an input green signal $G_{in}$ of 8 bits for making green display to be inputted, and an input blue signal $B_{in}$ of 8 bits for making blue display to be inputted.

A yellow signal generation circuit 2012 generates a yellow signal of 8 bits $$Ye=\min(R_{in}-W, G_{in}-W), \quad \text{(Formula 2)}$$

based on the input red signal $R_{in}$ to be inputted, the input green signal $G_{in}$ to be inputted, and the generated white signal W.

A first output white signal generation circuit 3012 generates a first output white signal $W_{out}^{(1)}$ of 8 bits for making the white display to be outputted, based on the generated white signal W and the generated yellow signal Ye.

More specifically, the first output white signal generation circuit 3012 generates the first output white signal $W_{out}^{(1)}$ in accordance with $$W_{out}^{(1)}=W+K_1\cdot Ye \quad \text{(Formula 3)}$$

for a predetermined positive constant $K_1$.

An output blue signal generation circuit 4003 generates an output blue signal $B_{out}$ of 8 bits for making the blue display to be outputted, based on the input blue signal $B_{in}$ for making the blue display to be inputted, the generated yellow signal Ye, and the generated white signal W.

More specifically, the output blue signal generation circuit 4003 generates the output blue signal $B_{out}$ in accordance with $$B_{out}=B_{in}-L\cdot Ye\cdot W \quad \text{(Formula 4)}$$

for a predetermined positive constant $L_1$.

The output blue signal generation circuit 4003 is not indispensable, as will be described later.

The white signal generation circuit 1000 corresponds to the white signal generation instrument of the invention, the yellow signal generation circuit 2012 corresponds to the yellow signal generation instrument of the invention, the first output white signal generation circuit 3012 corresponds to the first output white signal generation instrument of the invention, and the output blue signal generation circuit 4003 corresponds to the output blue signal generation instrument of the invention.

Herein, to facilitate the understanding of the invention, the principle of the color image processing apparatus of this embodiment will be described below.

In this embodiment, the white display is made using the first output white signal $$W_{out}^{(1)}=W+K_1\cdot Ye \quad \text{(Formula 3)}$$

for a predetermined positive constant $K_1$.

Through such image processing, as described earlier, the white display is made by increasing the white signal W by $K_1 \cdot Ye$ according to the magnitude of yellow signal Ye, whereby it is possible to suppress an evil influence that yellow looks darker because there is too large luminosity contrast with white of which luminosity is enhanced (see FIG. 1).

However, if the white display is made in this manner, yellow may become whitish and look lighter in color, although it is possible to suppress the evil influence that yellow looks darker.

Thus, in this embodiment, the blue display is made using the output blue signal $$B_{out}=B_{in}-L_1 \cdot Ye \cdot W \quad \text{(Formula 4)}$$

for a predetermined positive constant $L_1$.

Figure 3:
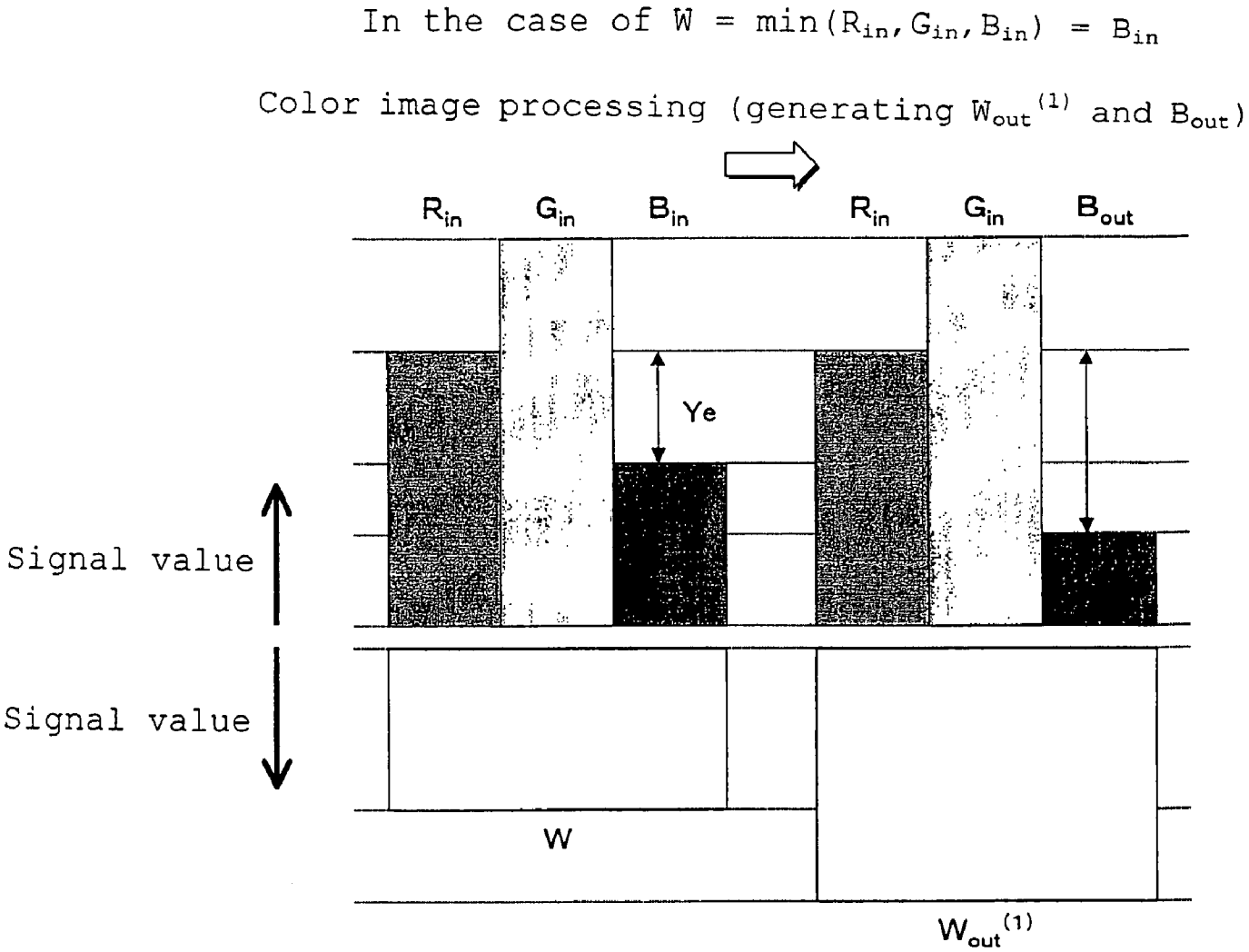
FIG. 3 is an explanatory view (No. 2) of the principle with pseudo-histograms in which the signal value of each signal is taken as the length of side of the rectangle in the longitudinal direction for the color image processing apparatus according to the embodiment of the invention.

Though the output blue signal generation circuit 4003 is not indispensable as previously described, if the image processing by the output blue signal generation circuit 4003 is performed, the blue display is made by decreasing the input blue signal $B_{in}$ by $L_1 \cdot Ye \cdot W$ according to the magnitude of yellow signal Ye and white signal W, as will be more clearly seen from FIG. 3 that is an explanatory diagram (No. 2) of the principle with pseudo-histograms in which the signal value of each signal is taken along the length of side of rectangle in the longitudinal direction for the color image processing apparatus according to this embodiment of the invention. Therefore, yellow is held by suppressing blue that is a complementary color of yellow, and unlikely to look lighter.

Thus, the high quality full color image display is implemented using the input red signal $R_{in}$, the input green signal $G_{in}$, the output blue signal $B_{out}$, and the first output white signal $W_{out}^{(1)}$.

Next, the configuration of the color image processing apparatus according to the embodiment of the invention will be described below in more detail.

The configuration of the white signal generation circuit 1000: the white signal generation circuit 1000 has a minimum value detector 100.

The minimum value detector 100 generates a minimum value $\min(R_{in},G_{in},B_{in})$ by comparing the input red signal $R_{in}$, the input green signal $G_{in}$, and the input blue signal $B_{in}$, and outputs the white signal $$W=\min(R_{in},G_{in},B_{in}). \quad \text{(Formula 1)}$$

The configuration of the yellow signal generation circuit 2012: the yellow signal generation circuit 2012 has a subtracter 201, a subtracter 302 and a minimum value detector 412.

The subtracter 201 is a circuit of subtracting the white signal W from the input red signal $R_{in}$ to generate a subtraction value $R_{in}-W$ and outputting the subtraction value $R_{in}-W$.

The subtracter 302 is a circuit of subtracting the white signal W from the input green signal $G_{in}$ to generate a subtraction value $G_{in}-W$ and outputting the subtraction value $G_{in}-W$.

The minimum value detector 412 generates a minimum value $\min(R_{in}-W, G_{in}-W)$ by comparing the subtraction value $R_{in}-W$ and the subtraction value $G_{in}-W$, and outputs a yellow signal $$Ye=\min(R_{in}-W,G_{in}-W). \quad \text{(Formula 2)}$$

The configuration of the first output white signal generation circuit 3012: the first output white signal generation circuit 3012 has a multiplier 512 and an adder 612.

The multiplier 512 is a circuit of multiplying the yellow signal Ye by a predetermined positive constant $K_1$ to generate a multiplication value $K_1 \cdot Ye$ and outputting the multiplication value $K_1 \cdot Ye$.

The adder 612 is a circuit of adding the multiplication value $K_1 \cdot Ye$ to the white signal W to generate an addition value $W+K_1 \cdot Ye$, and outputting the first output white signal $$W_{out}^{(1)}=W+K_1 \cdot Ye. \quad \text{(Formula 3)}$$

The configuration of the output blue signal generation circuit 4003: the output blue signal generation circuit 4003 has a multiplier 703, a multiplier 803 and a subtracter 903.

The multiplier 703 is a circuit of multiplying the yellow signal Ye by a predetermined positive constant $L_1$ to generate a multiplication value $L_1 \cdot Ye$ and outputting the multiplication value $L_1 \cdot Ye$.

The multiplier 803 is a circuit of multiplying the white signal W by the multiplication value $L_1 \cdot Ye$ to generate a multiplication value $L_1 \cdot Ye \cdot W$ and outputting the multiplication value $L_1 \cdot Ye \cdot W$.

The subtracter 903 subtracts the multiplication value $L_1 \cdot Ye \cdot W$ from the input blue signal $B_{in}$ to generate a subtraction value $B_{in}-L_1 \cdot Ye \cdot W$ and outputting the output blue signal $$B_{out}=B_{in}-L_1 \cdot Ye \cdot W. \quad \text{(Formula 4)}$$

The operation of the color image processing apparatus according to this embodiment of the invention will be described below.

One mode of the invention, along with the operation of the color image processing apparatus of this embodiment, will be described below.

The operation of the white signal generation circuit 1000: the minimum value detector 100 generates a minimum value $\min(R_{in},G_{in},B_{in})$ by comparing the input red signal $R_{in}$, the input green signal $G_{in}$, and the input blue signal $B_{in}$, and outputs a white signal $$W=\min(R_{in},G_{in},B_{in}). \quad \text{(Formula 1)}$$

The operation of the yellow signal generation circuit 2012: the subtracter 201 subtracts the white signal W from the input red signal $R_{in}$ to generate a subtraction value $R_{in}-W$ and outputs the subtraction value $R_{in}-W$.

The subtracter 302 subtracts the white signal W from the input green signal $G_{in}$ to generate a subtraction value $G_{in}-W$ and outputs the subtraction value $G_{in}-W$.

The minimum value detector 412 generates a minimum value $\min(R_{in}-W, G_{in}-W)$ by comparing the subtraction value $R_{in}-W$ and the subtraction value $G_{in}-W$, and outputs a yellow signal $$Ye=\min(R_{in}-W,G_{in}-W). \quad \text{(Formula 2)}$$

The operation of the first output white signal generation circuit 3012: the multiplier 512 multiplies the yellow signal Ye by a predetermined positive constant $K_1$ to generate a multiplication value $K_1 \cdot Ye$ and outputs the multiplication value $K_1 \cdot Ye$.

The adder 612 adds the multiplication value $K_1 \cdot Ye$ to the white signal W to generate an addition value $W+K_1 \cdot Ye$, and outputs a first output white signal $$W_{out}^{(1)}=W+K_1 \cdot Ye. \quad \text{(Formula 3)}$$

The operation of the output blue signal generation circuit 4003: the multiplier 703 multiplies the yellow signal Ye by a predetermined positive constant $L_1$ to generate a multiplication value $L_1 \cdot Ye$ and outputs the multiplication value $L_1 \cdot Ye$.

The multiplier 803 multiplies the white signal W by the multiplication value $L_1 \cdot Ye$ to generate a multiplication value $L_1 \cdot Ye \cdot W$ and outputs the multiplication value $L_1 \cdot Ye \cdot W$.

The subtracter 903 subtracts the multiplication value $L_1 \cdot Ye \cdot W$ from the input blue signal $B_{in}$ to generate a subtraction value $B_{in} - L_1 \cdot Ye \cdot W$ and outputs an output blue signal $$B_{out} = B_{in} - L_1 \cdot Ye \cdot W. \quad \text{(Formula 4)}$$

The mode of the invention has been described above in detail.

Figure 4:
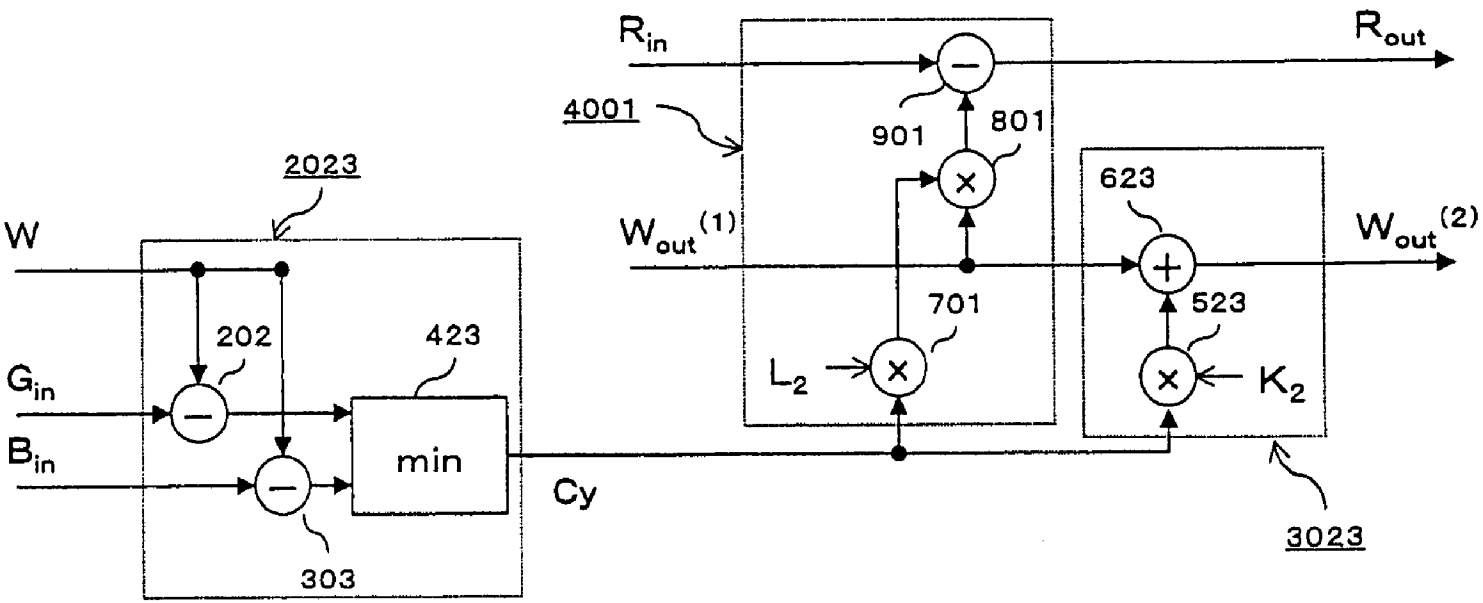
FIG. 4 is a partial block diagram (No. 1) of the color image processing apparatus according to the embodiment of the invention.

(A) The color image processing apparatus according to the invention may further comprise a cyan signal generation circuit 2023 of generating a cyan signal of 8 bits $$Cy = \min(G_{in} - W, B_{in} - W), \quad \text{(Formula 5)}$$

based on the input green signal $G_{in}$ to be inputted, the input blue signal $B_{in}$ to be inputted, and the generated white signal W, and a second output white signal generation circuit 3023 of generating a second output white signal $W_{out}^{(2)}$ of 8 bits for making the white display to be outputted, based on the generated first output white signal $W_{out}^{(1)}$ and the generated cyan signal Cy, as shown in FIG. 4 that is a partial block diagram (No. 1) of the color image processing apparatus according to the embodiment of the invention.

More specifically, the second output white signal generation circuit 3023 may generate the second output white signal $W_{out}^{(2)}$ in accordance with $$W_{out}^{(2)} = W_{out}^{(1)} + K_2 \cdot Cy \quad \text{(Formula 6)}$$

for a predetermined positive constant $K_2$.

In this manner, since the white display is made by increasing the first output white signal $W_{out}^{(1)}$ by $K_2 \cdot Cy$ according to the magnitude of the cyan signal Cy, it is possible to suppress an evil influence that cyan looks darker because there is too large luminosity contrast with white of which luminosity is enhanced.

However, if the white display is made in this manner, cyan may become whitish and look lighter in color, although it is possible to suppress the evil influence that cyan looks darker.

Thus, the color image processing apparatus of the invention may further comprise output red signal generation instrument 4001 which generates an output red signal $R_{out}$ of 8 bits for making the red display to be outputted, based on the input red signal $R_{in}$ for making the red display to be inputted, the generated cyan signal Cy, and the generated first output white signal $W_{out}^{(1)}$, as shown in FIG. 4.

More specifically, the output red signal generation instrument 4001 may generate the output red signal $R_{out}$ in accordance with $$R_{out} = R_{in} - L_2 \cdot Cy \cdot W_{out}^{(1)} \quad \text{(Formula 7)}$$

for a predetermined positive constant $L_2$.

In this manner, the red display is made by decreasing the input red signal $R_{in}$ by $L_2 \cdot Cy \cdot W_{out}^{(1)}$ according to the magnitude of cyan signal Cy and first output white signal $W_{out}^{(1)}$ whereby cyan is held by suppressing red that is a complementary color of cyan, and unlikely to look lighter.

The cyan signal generation circuit 2023 corresponds to the cyan signal generation instrument of the invention, the second output white signal generation circuit 3023 corresponds to the second output white signal generation instrument of the invention, and the output red signal generation circuit 4001 corresponds to the output red signal generation instrument of the invention.

Referring to FIG. 4, one example configuration of the color image processing apparatus will be described below in more detail.

The configuration of the cyan signal generation circuit 2023: the cyan signal generation circuit 2023 has a subtracter 202, a subtracter 303 and a minimum value detector 423.

The subtracter 202 is a circuit of subtracting the white signal W from the input red signal $G_{in}$ to generate a subtraction value $G_{in} - W$ and outputting the subtraction value $G_{in} - W$.

The subtracter 303 is a circuit of subtracting the white signal W from the input blue signal $B_{in}$ to generate a subtraction value $B_{in} - W$ and outputting the subtraction value $B_{in} - W$.

The minimum value detector 423 generates a minimum value $\min(G_{in} - W, B_{in} - W)$ by comparing the subtraction value $G_{in} - W$ and the subtraction value $B_{in} - W$, and outputs a cyan signal $$Cy = \min(G_{in} - W, B_{in} - W). \quad \text{(Formula 5)}$$

The configuration of the second output white signal generation circuit 3023: the second output white signal generation circuit 3023 has a multiplier 523 and an adder 623.

The multiplier 523 is a circuit of multiplying the cyan signal Cy by a predetermined positive constant $K_2$ to generate a multiplication value $K_2 \cdot Cy$ and outputting the multiplication value $K_2 \cdot Cy$.

The adder 623 is a circuit of adding the multiplication value $K_2 \cdot Cy$ to the first output white signal $W_{out}^{(1)}$ to generate an addition value $W_{out}^{(1)} + K_2 \cdot Cy$, and outputting a second output white signal $$W_{out}^{(2)} = W_{out}^{(1)} + K_2 \cdot Cy. \quad \text{(Formula 6)}$$

The configuration of the output red signal generation circuit 4001: the output red signal generation circuit 4001 has a multiplier 701, a multiplier 801 and a subtracter 901.

The multiplier 701 is a circuit of multiplying the cyan signal Cy by a predetermined positive constant $L_2$ to generate a multiplication value $L_2 \cdot Cy$ and outputting the multiplication value $L_2 \cdot Cy$.

The multiplier 801 is a circuit of multiplying the first output white signal $W_{out}^{(1)}$ by the multiplication value $L_2 \cdot Cy$ to generate a multiplication value $L_2 \cdot Cy \cdot W_{out}^{(1)}$ and outputting the multiplication value $L_2 \cdot Cy \cdot W_{out}^{(1)}$.

The subtracter 901 is a circuit of subtracting the multiplication value $L_2 \cdot Cy \cdot W_{out}^{(1)}$ from the input red signal $R_{in}$ to generate a subtraction value $R_{in} - L_2 \cdot Cy \cdot W_{out}^{(1)}$ and outputting an output red signal $$R_{out} = R_{in} - L_2 \cdot Cy \cdot W_{out}^{(1)}. \quad \text{(Formula 7)}$$

Employing the color image processing apparatus of this configuration, the high quality full color image display is implemented using the output red signal $R_{out}$, the input green signal $G_{in}$, the output blue signal $B_{out}$, and the second output white signal $W_{out}^{(2)}$.

Figure 5:
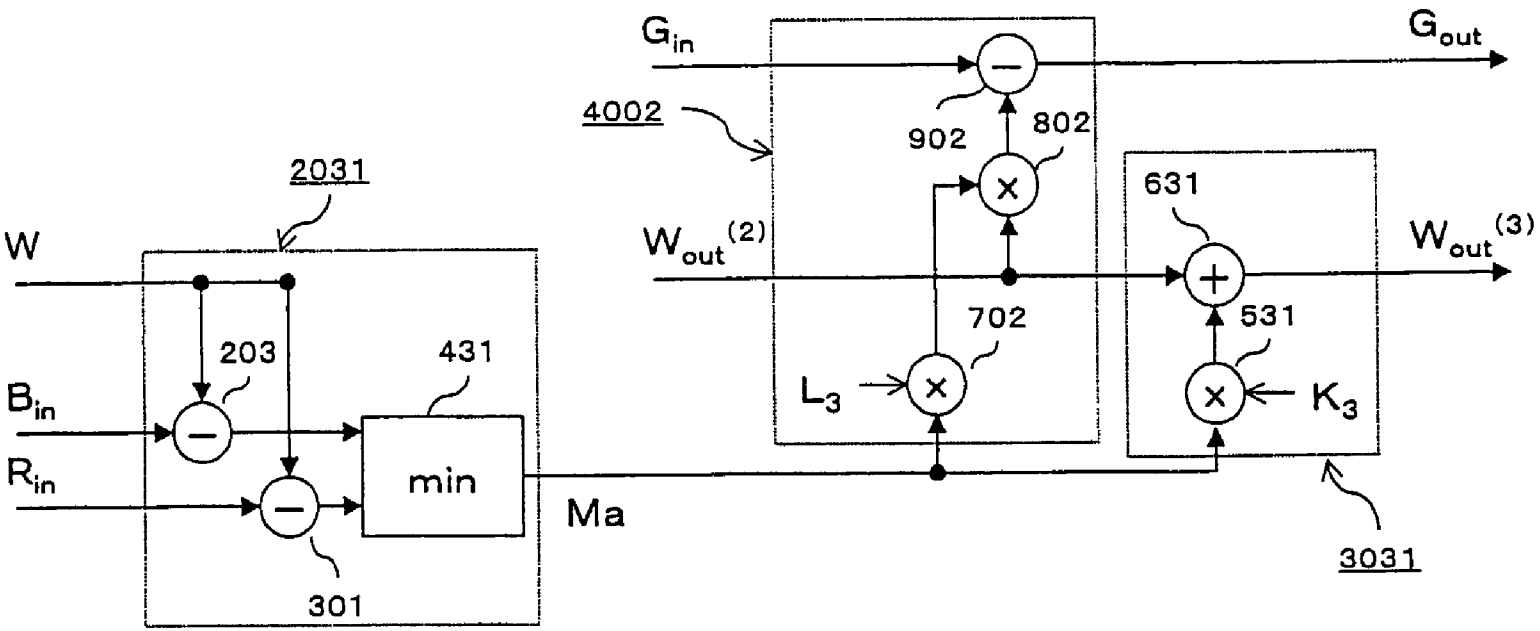
FIG. 5 is a partial block diagram (No. 2) of the color image processing apparatus according to the embodiment of the invention.

(B) The color image processing apparatus according to the invention may further comprise a magenta signal generation circuit 2031 of generating a magenta signal of 8 bits $$Ma = \min(B_{in} - W, R_{in} - W), \quad \text{(Formula 8)}$$

based on the input blue signal $B_{in}$ to be inputted, the input red signal $R_{in}$ to be inputted, and the generated white signal W, and a third output white signal generation circuit 3031 of generating a third output white signal $W_{out}^{(3)}$ of 8 bits for making the white display to be outputted, based on the generated second output white signal $W_{out}^{(2)}$ and the generated magenta signal Ma, as shown in FIG. 5 that is a partial block diagram (No. 2) of the color image processing apparatus according to the embodiment of the invention.

More specifically, the third output white signal generation circuit 3031 may generate the third output white signal $W_{out}^{(3)}$ in accordance with $$W_{out}^{(3)}=W_{out}^{(2)}+K_3 \cdot Ma \quad \text{(Formula 9)}$$

for a predetermined positive constant $K_3$.

In this manner, since the white display is made by increasing the second output white signal $W_{out}^{(2)}$ by $K_3 \cdot Ma$ according to the magnitude of the magenta signal Ma, it is possible to suppress an evil influence that magenta looks darker because there is too large luminosity contrast with white of which luminosity is enhanced.

However, if the white display is made in this manner, magenta may become whitish and look lighter in color, although it is possible to suppress the evil influence that magenta looks darker.

Thus, the color image processing apparatus of the invention may further comprise output green signal generation instrument 4002 which generates an output green signal $G_{out}$ of 8 bits for making the green display to be outputted, based on the input green signal $G_{in}$ for making the green display to be inputted, the generated magenta signal Ma, and the generated second output white signal $W_{out}^{(2)}$ as shown in FIG. 5.

More specifically, the output green signal generation instrument 4002 may be a circuit of generating the output green signal $G_{out}$ in accordance with $$G_{out}=G_{in}-L_3 \cdot Ma \cdot W_{out}^{(2)} \quad \text{(Formula 10)}$$

for a predetermined positive constant $L_3$.

In this manner, the green display is made by decreasing the input green signal $G_{in}$ by $L_3 \cdot Ma \cdot W_{out}^{(2)}$ according to the magnitude of magenta signal Ma and second output white signal $W_{out}^{(2)}$, whereby magenta is held by suppressing green that is a complementary color of magenta, and unlikely to look lighter.

The magenta signal generation circuit 2031 corresponds to the magenta signal generation instrument of the invention, the third output white signal generation circuit 3031 corresponds to the third output white signal generation instrument of the invention, and the output green signal generation circuit 4002 corresponds to the output green signal generation instrument of the invention.

Referring to FIG. 5, one example configuration of the color image processing apparatus will be described below in more detail.

The configuration of the magenta signal generation circuit 2031: the magenta signal generation circuit 2031 has a subtracter 203, a subtracter 301 and a minimum value detector 431.

The subtracter 203 is a circuit of subtracting the white signal W from the input blue signal $B_{in}$ to generate a subtraction value $B_{in}-W$ and outputting the subtraction value $B_{in}-W$.

The subtracter 301 is a circuit of subtracting the white signal W from the input red signal $R_{in}$ to generate a subtraction value $R_{in}-W$ and outputting the subtraction value $R_{in}-W$.

The minimum value detector 431 is a circuit of generating a minimum value $\min(B_{in}-W, R_{in}-W)$ by comparing the subtraction value $B_{in}-W$ and the subtraction value $R_{in}-W$, and outputting a magenta signal $$Ma=\min(B_{in}-W, R_{in}-W). \quad \text{(Formula 8)}$$

The configuration of the third output white signal generation circuit 3031: the third output white signal generation circuit 3031 has a multiplier 531 and an adder 631.

The multiplier 531 is a circuit of multiplying the magenta signal Ma by a predetermined positive constant $K_3$ to generate a multiplication value $K_3 \cdot Ma$ and outputting the multiplication value $K_3 \cdot Ma$.

The adder 631 is a circuit of adding the multiplication value $K_3 \cdot Ma$ to the second output white signal $W_{out}^{(2)}$ to generate an addition value $W_{out}^{(2)}+K_3 \cdot Ma$, and outputting the third output white signal $$W_{out}^{(3)}=W_{out}^{(2)}+K_3 \cdot Ma. \quad \text{(Formula 9)}$$

The configuration of the output green signal generation circuit 4002: the output green signal generation circuit 4002 has a multiplier 702, a multiplier and a subtracter 902.

The multiplier 702 is a circuit of multiplying the magenta signal Ma by a predetermined positive constant $L_3$ to generate a multiplication value $L_3 \cdot Ma$ and outputting the multiplication value $L_3 \cdot Ma$.

The multiplier 802 is a circuit of multiplying the second output white signal $W_{out}^{(2)}$ by the multiplication value $L_3 \cdot Ma$ to generate a multiplication value $L_3 \cdot Ma \cdot W_{out}^{(2)}$ and outputting the multiplication value $L_3 \cdot Ma \cdot W_{out}^{(2)}$.

The subtracter 902 is a circuit of subtracting the multiplication value $L_3 \cdot Ma \cdot W_{out}^{(2)}$ from the input green signal $G_{in}$ to generate a subtraction value $G_{in}-L_3 \cdot Ma \cdot W_{out}^{(2)}$ and outputting an output green signal $$G_{out}=G_{in}-L_3 \cdot Ma \cdot W_{out}^{(2)}. \quad \text{(Formula 10)}$$

Employing the color image processing apparatus of this configuration, the high quality full color image display is implemented using the output red signal $R_{out}$, the output green signal $G_{out}$, the output blue signal $B_{out}$ and the third output white signal $W_{out}^{(3)}$.

(C) The color image processing apparatus of the invention performs the color image display using the liquid crystal pixel 5 in the embodiment.

Figure 6:
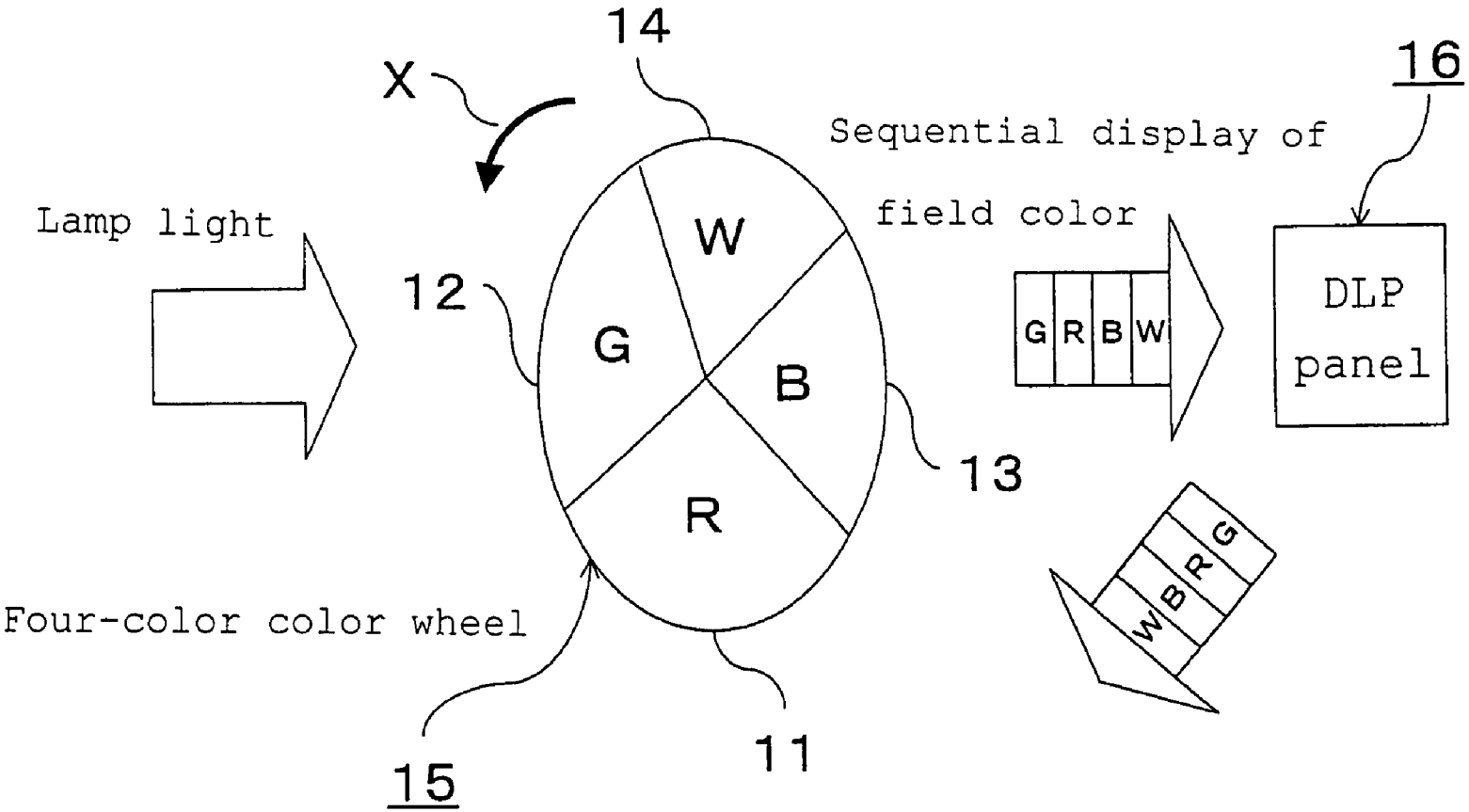
FIG. 6 is an explanatory diagram of a four-color color wheel 15 and a DLP panel 16 in the embodiment of the invention.
Figure 10:
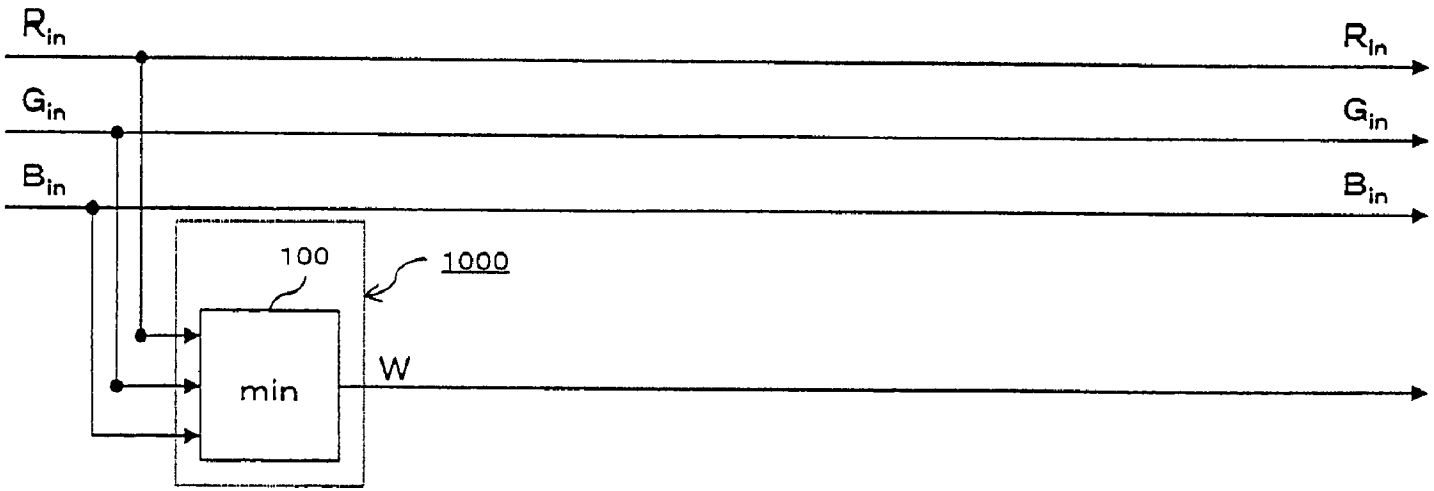
FIG. 10 is a block diagram of the conventional color image processing apparatus.

Additionally, the color image processing apparatus of the invention may perform the color image display using a four-color color wheel 15 and a DLP panel 16, as shown in FIG. 6 that is an explanatory diagram of the four-color color wheel 15 and the DLP panel 16 in the embodiment of the invention.

The four-color color wheel 15 has a red filter 11 for making the red display, a green filter 12 for making the green display, a blue filter 13 for making the blue display, and a transparent filter 14 for making the white display. The four-color color wheel 15 has an RGBW four-color segment for use in the DLP projector of color sequential method, called a field sequential method. Herein, though the central angle of the segment of the transparent filter 14 is about 70 degrees, the brightness ratio of white using the red filter 11, the green filter and the blue filter 13 with a total gradation of 255 to white using the transparent filter 14 is about 1:1, and the light transmittance, called a CW (Color Wheel) efficiency, over the entire four-color color wheel 15 is about 50%.

The four-color color wheel 15 produces a red color light for making the red display, a green color light for making the green display, a blue color light for making the blue display and a white color light for making the white display in every corresponding time zone by rotating in a direction of the arrow X. The produced light is led by an optical system in a combination of relay lenses (not shown) and mirrors (not shown), arriving at the DLP panel 16. The DLP panel 16 generates a gradation for the arriving light and reflects its light to a projection lens (not shown). And the projection lens (not shown) projects the reflected light as the mixed color light onto a screen (not shown).

Thus, the full color image display is made by the color sequential method using the four-color color wheel and the DLP panel 16.

(D) The color image processing apparatus of the invention performs the arithmetical operation using the multipliers like the multiplier 512 in the above embodiment.

Additionally, the color image processing apparatus of the invention may perform the arithmetical operation using an adder or shifter for making the addition or shift (carry) and/or a ROM.

The circuit configuration is simplified by using the adder or shifter and/or the ROM.

(E) A program of the invention enables a computer to perform the operation of steps in a part or all of the color image processing method of the invention and is operable in cooperation with the computer.

Also, a recording medium of the invention records the program for enabling the computer to perform a part or all of the operation of steps in a part or all of the color image processing method of the invention, and is readable by the computer, the read program being operable in cooperation with the computer.

The "part of steps" of the invention means one or more steps among a plurality of steps.

The "operation of steps" of the invention means all or part of the operation of the steps.

In one use form of the program of the invention, the program may be recorded on the recording medium readable by the computer and operable in cooperation with the computer.

In another use form of the program of the invention, the program is transmitted through the transmission media, read by the computer and operated in cooperation with the computer.

The recording medium may be a ROM, and the transmission media may be the Internet, light, radio wave and sound wave.

Also, the computer of the invention is not limited to the pure hardware such as CPU, but may comprise firmware, OS, and peripheral devices.

As described above, the configuration of the invention may be implemented by software or by hardware.

EXAMPLES

The examples of the invention will be specifically described below.

In the examples (comparative example and examples 1, 2), a linear RGB signal subjected to inverse gamma conversion for an original RGB signal gamma converted is employed as an input RGB signal to be inputted into the color image processing apparatus according to this embodiment. More specifically, the linear signal subjected to inverse gamma conversion for the original red signal $R_o$ gamma converted for making the red display is defined as the input red signal $R_{in}$ for making the red display;

the linear signal subjected to inverse gamma conversion for the original green signal $G_o$ gamma converted for making the green display is defined as the input green signal $G_{in}$ for making the green display; and the linear signal subjected to inverse gamma conversion for the original blue signal $B_o$ gamma converted for making the blue display is defined as the input blue signal $B_{in}$ for making the blue display.

Of course, a white burst input signal that is the minimum value of the linear RGB signal is the white signal W in the embodiment.

All the gamma values γ in the examples (comparative example and examples 1, 2) are 2.2.

Also, the CRT monitor in the examples (comparative example and examples 1, 2) makes the display using three primary colors of red, green and blue without addition of white.

Comparative Example

In this comparative example, the color image processing in the embodiment of the invention is not performed at all.

That is, in this comparative example, a white burst output signal w is generated by subtracting 30% of the white signal W that is a white burst input signal and clipping, and performing the gain adjustment of normalizing the maximum amplitude to 1.

And a display RGB signal for simulation display on the CRT monitor is generated by adding the white burst output signal w to the linear RGB signal subjected to inverse gamma conversion, making the gain adjustment of ½ times, and making the gamma conversion. More specifically, a red display signal $R_d^{(0)}$ for making the red display on the CRT monitor is generated by adding the white burst output signal w to the input red signal $R_{in}$, making the gain adjustment, and making the gamma conversion;

a green display signal $G_d^{(0)}$ for making the green display on the CRT monitor is generated by adding the white burst output signal w to the input green signal $G_{in}$, making the gain adjustment, and making the gamma conversion; and a blue display signal $B_d^{(0)}$ for making the blue display on the CRT monitor is generated by adding the white burst output signal w to the input blue signal $B_{in}$, making the gain adjustment, and making the gamma conversion.

The results of the color image processing in this comparative example in terms of the original RGB signals ($R_o$, $G_o$,$B_o$)=(255,255,0), (255,255,51), (255,255,102), (255,255,153) and (255,255,204) are shown in FIG. 7, which is an explanatory diagram of the simulation results of the color image processing in the comparative example of the invention.

Example 1

In this example 1, the color image processing in the above embodiment is performed, except for the color image processing of suppressing blue that is a complementary color of yellow.

That is, in this example, a first white burst output signal $w_{out}^{(1)}$ is generated by subtracting 30% of the first output white signal $W_{out}^{(1)}$, but not the white signal W itself that is the white burst input signal, and clipping, and performing the gain adjustment of normalizing the maximum amplitude to 1.

And a display RGB signal for simulation display on the CRT monitor is generated by adding the first white burst output signal $w_{out}^{(1)}$ to a linear RGB signal subjected to inverse gamma conversion, making the gain adjustment of ½ times, and making the gamma conversion. More specifically, a red display signal $R_d^{(1)}$ for making the red display on the CRT monitor is generated by adding the first white burst output signal $w_{out}^{(1)}$ to the input red signal $R_{in}$, making the gain adjustment, and making the gamma conversion;

a green display signal $G_d^{(1)}$ for making the green display on the CRT monitor is generated by adding the first white burst output signal $w_{out}^{(1)}$ to the input green signal $G_{in}$, making the gain adjustment, and making the gamma conversion; and a blue display signal $B_d^{(1)}$ for making the blue display on the CRT monitor is generated by adding the first white burst output signal $w_{out}^{(1)}$ to the input blue signal $B_{in}$, making the gain adjustment, and making the gamma conversion.

The results of the color image processing in this example in terms of the original RGB signals $(R_o,G_o,B_o)$=(255,255,0), (255,255,51), (255,255,102), (255,255,153) and (255,255,204), like the comparative example, for $K_1$=0.3 and $K_1$=0.4, are shown in FIG. 8, which is an explanatory diagram of the simulation results of the color image processing in the example 1 of the invention.

Example 2

In this example 2, the color image processing in the above embodiment is all performed, including the color image processing of suppressing blue that is a complementary color of yellow.

That is, in this example 2, like the example 1, a first white burst output signal $w_{out}^{(1)}$ is generated by subtracting 30% of the first output white signal $W_{out}^{(1)}$, but not the white signal W itself that is the white burst input signal, and clipping, and performing the gain adjustment of normalizing the maximum amplitude to 1.

And a display RGB signal for simulation display on the CRT monitor is generated by adding the first white burst output signal $w_{out}^{(1)}$ to a linear RGB signal subjected to inverse gamma conversion and the color image processing of suppressing blue that is a complementary color of yellow, making the gain adjustment of ½ times, and making the gamma conversion. More specifically, a red display signal $R_d^{(1)}$ for making the red display on the CRT monitor is generated by adding the first white burst output signal $w_{out}^{(1)}$ to the input red signal $R_{in}$, making the gain adjustment, and making the gamma conversion;

a green display signal $G_d^{(1)}$ for making the green display on the CRT monitor is generated by adding the first white burst output signal $w_{out}^{(1)}$ to the input green signal $G_{in}$, making the gain adjustment, and making the gamma conversion; and a blue display signal $B_d^{(2)}$ for making the blue display on the CRT monitor is generated by adding the first white burst output signal $w_{out}^{(1)}$ to the output blue signal $B_{out}$, but not the input blue signal $B_{in}$, making the gain adjustment, and making the gamma conversion.

The results of the color image processing in this example in terms of the original RGB signals $(R_o,G_o,B_o)$=(255,255,0), (255,255,51), (255,255,102), (255,255,153) and (255,255,204), like the example 1, for $(K_1,L_1)$=(0.3,1) and $(K_1,L_1)$=(0.4,1), are shown in FIG. 9, which is an explanatory diagram of the simulation results of the color image processing in the example 2 of the invention.

Comparing the simulation results (FIG. 8) of the example 1 with the simulation results (FIG. 7) of the comparative example, the red display signal $R_d^{(1)}$ is greater than the red display signal $R_d^{(0)}$, the green display signal $G_d^{(1)}$ is greater than the green display signal $G_d^{(0)}$, and the blue display signal $B_d^{(1)}$ is greater than the blue display signal $B_d^{(0)}$. Therefore, it is unlikely that yellow looks darker than white.

In the case of $K_1$=0.3, regarding the original RGB signal $(R_o,G_o,B_o)$=(255,255,0), the red display signal $R_d^{(1)}$ is equal to the red display signal $R_d^{(0)}$, the green display signal $G_d^{(1)}$ is equal to the green display signal $G_d^{(0)}$, and the blue display signal $B_d^{(1)}$ is equal to the blue display signal $B_d^{(0)}$. As will be understood from the specific example, it is desirable that a predetermined positive constant $K_1$ is naturally more or less great to attain the effect with the original RGB signal in which the white signal W is small.

Of course, the same thing applies in a composition where a yellow object is disposed in the background of white. More specifically, the present inventor made sure that in a natural picture where a yellow lemon is disposed on a white tablecloth, yellow of the lemon is unlikely to look sordid and dark against white of the tablecloth.

In the simulation results (see FIG. 9) of this example 2, the blue display signal $B_d^{(2)}$ is smaller in terms of the original RGB signals except for $(R_o,G_o,B_o)$=(255,255,0) than the blue display signal $B_d^{(1)}$ in the simulation results (see FIG. 8) of the example 1. Therefore, it is unlikely that yellow looks whitish and lighter.

The color image processing apparatus according to the invention can effectively reduce a sense of incompatibility in the appearance of the colors, such as yellow looking darker, in the color image display using the red display, green display, blue display and white display.

The invention claimed is:

1. A color image processing apparatus of performing a color image display using a red display, a green display, a blue display and a white display, comprising:

white signal generation instrument which generates a white signal $$W=\min(R_{in},G_{in},B_{in}), \quad \text{(Formula 1)}$$

based on an input red signal $R_{in}$ for making said red display to be inputted, an input green signal $G_{in}$ for making said green display to be inputted, and an input blue signal $B_{in}$ for making said blue display to be inputted;

yellow signal generation instrument which generates a yellow signal $$Ye=\min(R_{in}-W,G_{in}-W), \quad \text{(Formula 2)}$$

based on said input red signal $R_{in}$ to be inputted, said input green signal $G_{in}$ to be inputted, and said generated white signal W; and first output white signal generation instrument which generates a first output white signal $W_{out}^{(1)}$ for making said white display to be outputted, based on said generated white signal W and said generated yellow signal Y, wherein said first output white signal generation instrument generates said first output white signal $W_{out}^{(1)}$ $$W_{out}^{(1)}=W+K_1\cdot Ye \quad \text{(Formula 3)}$$

for a predetermined positive constant $K_1$.

2. The color image processing apparatus according to claim 1, further comprising output blue signal generation instrument which generates an output blue signal $B_{out}$ for making said blue display to be outputted, based on said input blue signal $B_{in}$ for making the blue display to be inputted, said generated yellow signal Ye, and said generated white signal W.

3. The color image processing apparatus according to claim 2, wherein said output blue signal generation instrument generates said output blue signal $B_{out}$ $$B_{out}=B_{in}-L_1\cdot Ye\cdot W \quad \text{(Formula 4)}$$

for a predetermined positive constant $L_1$.

4. The color image processing apparatus according to claim 1, further comprising cyan signal generation instrument which generates a cyan signal $$Cy=\min(G_{in}-W,B_{in}-W), \quad \text{(Formula 5)}$$

based on said input green signal $G_{in}$ to be inputted, said input blue signal $B_{in}$ to be inputted, and said generated white signal W, and second output white signal generation instrument which generates a second output white signal $W_{out}^{(2)}$ for making said white display to be outputted, instead of said first output white signal $W_{out}^{(1)}$, based on said generated first output white signal $W_{out}^{(1)}$ and said generated cyan signal Cy.

5. The color image processing apparatus according to claim 4, wherein said second output white signal generation instrument generates said second output white signal $W_{out}^{(2)}$ $$W_{out}^{(2)}=W_{out}^{(1)}+K_2\cdot Cy \quad \text{(Formula 6)}$$

for a predetermined positive constant $K_2$.

6. The color image processing apparatus according to claim 4, further comprising output red signal generation instrument which generates an output red signal $R_{out}$ for making said red display to be outputted, based on said input red signal $R_{in}$ for making the red display to be inputted, said generated cyan signal Cy, and said generated first output white signal $W_{out}^{(1)}$.

7. The color image processing apparatus according to claim 6, wherein said output red signal generation instrument generates said output red signal $R_{out}$ $$R_{out}=R_{in}-L_2\cdot Cy\cdot W_{out}^{(1)} \quad \text{(Formula 7)}$$

for a predetermined positive constant $L_2$.

8. The color image processing apparatus according to claim 4, further comprising magenta signal generation instrument which generates a magenta signal $$Ma=\min(B_{in}-W,R_{in}-W), \quad \text{(Formula 8)}$$

based on said input blue signal $B_{in}$ to be inputted, said input red signal $R_{in}$ to be inputted, and said generated white signal W, and third output white signal generation instrument which generates a third output white signal $W_{out}^{(3)}$ for making said white display to be outputted, instead of said second output white signal $W_{out}^{(2)}$, based on said generated second output white signal $W_{out}^{(2)}$ and said generated magenta signal Ma.

9. The color image processing apparatus according to claim 8, wherein said third output white signal generation instrument generates said third output white signal $W_{out}^{(3)}$ $$W_{out}^{(3)}=W_{out}^{(2)}+K_3\cdot Ma \quad \text{(Formula 9)}$$

for a predetermined positive constant $K_3$.

10. The color image processing apparatus according to claim 8, further comprising output green signal generation instrument which generates an output green signal $G_{out}$ for making said green display to be outputted, based on said input green signal $G_{in}$ for making the green display to be inputted, said generated magenta signal Ma, and said generated second output white signal $W_{out}^{(2)}$.

11. The color image processing apparatus according to claim 10, wherein said output green signal generation instrument generates said output green signal $G_{out}$ $$G_{out}=G_{in}-L_3\cdot Ma\cdot W_{out}^{(2)} \quad \text{(Formula 10)}$$

for a predetermined positive constant $L_3$.

12. A color image processing method of performing a color image display using a red display, a green display, a blue display and a white display, comprising:

a white signal generation step of generating a white signal $$W=\min(R_{in},G_{in},B_{in}), \quad \text{(Formula 1)}$$

based on an input red signal $R_{in}$ for making said red display to be inputted, an input green signal $G_{in}$ for making said green display to be inputted, and an input blue signal $B_{in}$ for making said blue display to be inputted;

a yellow signal generation step of generating a yellow signal $$Ye=\min(R_{in}-W,G_{in}-W), \quad \text{(Formula 2)}$$

based on said input red signal $R_{in}$ to be inputted, said input green signal $G_{in}$ to be inputted, and said generated white signal W; and a first output white signal generation step of generating a first output white signal $W_{out}^{(1)}$ for making said white display to be outputted, based on said generated white signal W and said generated yellow signal Y, wherein said first output white signal $W_{out}^{(1)}$ is generated as $$W_{out}^{(1)}=W+K_1\cdot Ye \quad \text{(Formula 3)}$$

for a predetermined positive constant $K_1$.

13. The color image processing method according to claim 12, further comprising an output blue signal generation step of generating an output blue signal $B_{out}$ for making said blue display to be outputted, based on said input blue signal $B_{in}$ for making the blue display to be inputted, said generated yellow signal Ye, and said generated white signal W.

14. The color image processing method according to claim 12, further comprising a cyan signal generation step of generating a cyan signal $$Cy=\min(G_{in}-W,B_{in}-W), \quad \text{(Formula 5)}$$

based on said input green signal $G_{in}$ to be inputted, said input blue signal $B_{in}$ to be inputted, and said generated white signal W, and a second output white signal generation step of generating a second output white signal $W_{out}^{(2)}$ for making said white display to be outputted, instead of said first output white signal $W_{out}^{(1)}$, based on said generated first output white signal $W_{out}^{(1)}$ and said generated cyan signal Cy.

15. The color image processing method according to claim 14, further comprising an output red signal generation step of generating an output red signal $R_{out}$ for making said red display to be outputted, based on said input red signal $R_{in}$ for making the red display to be inputted, said generated cyan signal Cy, and said generated first output white signal $W_{out}^{(1)}$.

16. The color image processing method according to claim 14, further comprising a magenta signal generation step of generating a magenta signal $$Ma=\min(B_{in}-W,R_{in}-W), \quad \text{(Formula 8)}$$

based on said input blue signal $B_{in}$ to be inputted, said input red signal $R_{in}$ to be inputted, and said generated white signal W, and a third output white signal generation step of generating a third output white signal $W_{out}^{(3)}$ for making said white display to be outputted, instead of said second output white signal $W_{out}^{(2)}$, based on said generated second output white signal $W_{out}^{(2)}$ and said generated magenta signal Ma.

17. The color image processing method according to claim 16, further comprising an output green signal generation step of generating an output green signal $G_{out}$ for making said green display to be outputted, based on said input green signal $G_{in}$ for making the green display to be inputted, said generated magenta signal Ma, and said generated second output white signal $W_{out}^{(2)}$.

18. A recording medium which is computer processable and records a program for enabling a computer to perform the color image processing method according to claim 12, comprising:

a white signal generation step of generating a white signal $$W=\min(R_{in},G_{in},B_{in}), \quad \text{(Formula 1)}$$

based on an input red signal $R_{in}$ for making said red display to be inputted, an input green signal $G_{in}$ for making said green display to be inputted, and an input blue signal $B_{in}$ for making said blue display to be inputted;

a yellow signal generation step of generating a yellow signal $$Ye=\min(R_{in}-W,G_{in}-W), \quad \text{(Formula 2)}$$

based on said input red signal $R_{in}$ to be inputted, said input green signal $G_{in}$ to be inputted, and said generated white signal W; and a first output white signal generation step of generating a first output white signal $W_{out}^{(1)}$ for making said white display to be outputted, based on said generated white signal W and said generated yellow signal Ye.

* * * * *